United States Patent [19]

Yang

[11] Patent Number: 4,650,181

[45] Date of Patent: Mar. 17, 1987

[54] DYNAMIC ROWING MACHINE

[76] Inventor: Tzu-Tsan Yang, P.O. Box 13-118, Taipei, Taiwan

[21] Appl. No.: 820,682

[22] Filed: Jan. 21, 1986

[51] Int. Cl.[4] ..... A63B 69/06

[52] U.S. Cl. ..... 272/72

[58] Field of Search ..... 272/72, 73, 44, 54, 272/55, 56, 30, 111

[56] References Cited

U.S. PATENT DOCUMENTS

| | | | |
|---|---|---|---|
| 242,073 | 5/1881 | Terry | 272/72 |
| 496,759 | 5/1893 | Timby | 272/44 |
| 3,089,699 | 5/1963 | Flesch | 272/54 |
| 3,394,934 | 7/1968 | Elia et al. | 272/72 |

FOREIGN PATENT DOCUMENTS

| | | | |
|---|---|---|---|
| 383830 | 11/1932 | United Kingdom | 272/72 |

*Primary Examiner*—Richard J. Apley
*Assistant Examiner*—S. R. Crow

[57] ABSTRACT

A dynamic rowing machine includes a seat moved along a pair of corrugated rails formed on a seat base under the seat so that when pulling the oar handle to move the seat, an operation to imitate the actual outdoor rowing motion to thereby increase the user's interest.

5 Claims, 7 Drawing Figures

DYNAMIC ROWING MACHINE

BACKGROUND OF THE INVENTION

Conventional rowing machine used for gymnastic purpose always includes a seat movably rolling on a seat base when operating the two oar handles to imitate the rowing of a boat, which however has the following defects:

1. The machine is constructed as a fixed type to be lacking of vividness so that its rowing operation just serves as a physical training without having the interested feeling as felt in a true boat-bowing.

2. The rowing action is operated by merely moving the seat reciprocatively along the rails under the seat in a regular way, to thereby be impossible to feel or enjoy the waving as a true boat floating on a tide or water waves.

The present invention has found the defects of a conventional rowing machine and invented the present dynamic rowing machine.

SUMMARY OF THE INVENTION

The object of the present invention is to provide a rowing machine including a seat base, a seat moving on the seat base, a pair of oar handles pivotedly mounted on a central bar formed on the base and a pair of restoring cylinders each pivotedly secured between each handle and a front bar or a rear bar formed on the base, wherein the seat base is formed with a pair of corrugated rails formed on two opposite longitudinal edges of the base so that the seat can be moved along the corrugated rails to simulate the bowing of a boat to increase the player's interest.

DETAILED DESCRIPTION

Figure 1:
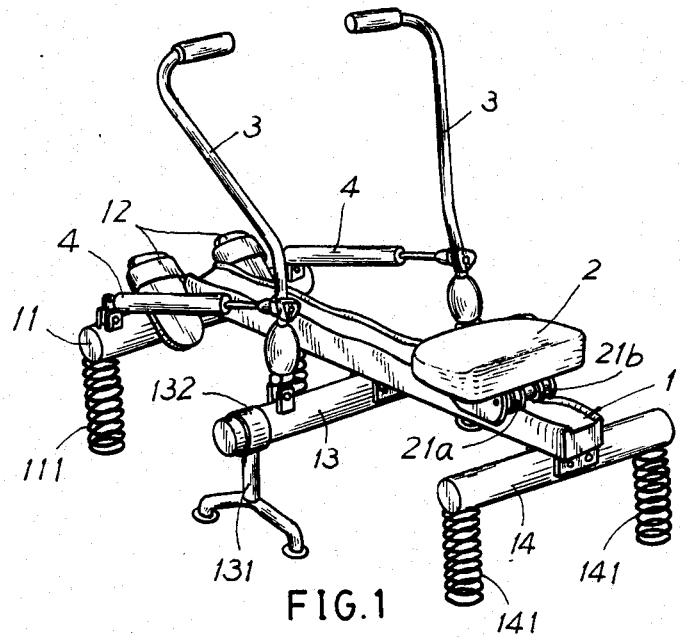
FIG. 1 is a perspective drawing of the present invention.

As shown in FIG. 1, the present invention comprises: a seat base 1, a seat 2 moving on the base 1, two oar handles 3 respectively pivotedly mounted on the two opposite sides of a central bar 13 on the base 1, and two restoring cylinders 4 each pivotedly secured between each handle 3 and each end of end portion of a front bar 11 on the base 1.

Two pedals 12 are disposed on both sides of the base 1 and are each pivotedly mounted on each side of the front bar 11 transversely formed on the front portion of base 1. Two cushioning springs 111 are respectively formed under both end portions of front bar 11. The central bar 13 transversely is formed on the central positions of base 1 and is rotatably mounted within a pair of collars each having a bearing 132 and each mounted on a fulcrum stand 131, such that each stand 131 supports each end portion of the central bar 13. A pair of cushioning springs 141 are formed under both end portions of the rear bar 14 transversely formed on the rear portion of base 1. The restoring cylinder 4 can be chosen from any conventional cylinder wellknown in the field for making a rowing machine, conventional cylinder used in wellknown rowing machine, having a restoring spring and hydraulic oil in the cylinder. The central fulcrum stand 131 can also be formed as a cushioning spring for central cushioning (not shown).

Figure 2:
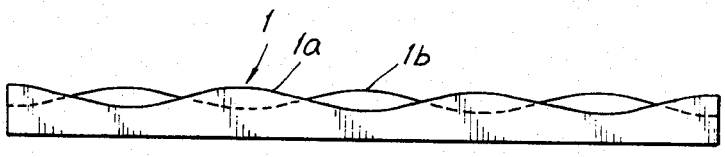
FIG. 2 is an illustration showing the corrugated rails of the present invention.
Figure 3:
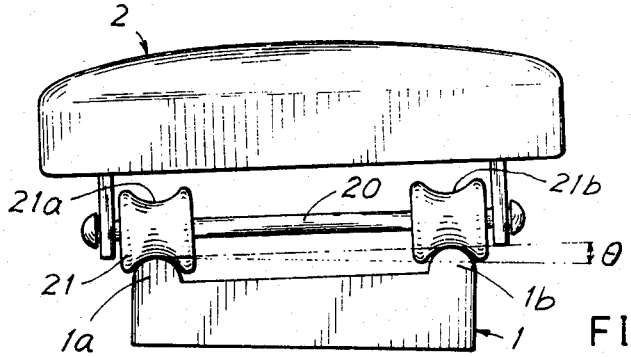
FIG. 3 is a side-view illustration of the seat and rails in accordance with the present invention.
Figure 7:
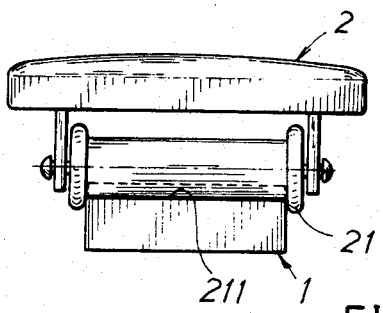
FIG. 7 shows still another preferred embodiment of the present invention, in which the base is formed with a pair of symmetrical rails.

The seat base 1 is formed with a pair of corrugated rails 1*a*, 1*b* formed on two opposite longitudinal edges of base 1 which are unsymmetrical when projectively viewed from transverse direction, as shown in FIGS. 1 and 2. The seat 2 is formed with at least a pair of wheels 21 each formed with an annular arched groove 21*a* along the wheel perimeter to rotatably move on each corrugated rail or 1*b* each being cancave downwards from its transverse sectional view to movably engage with the annular arched groove 21*a* of wheel 21. As shown in FIG. 3, one corrugated rail 1*b* may be higher than another corrugated rail 1*a* to form a slope transversely across the width of the base 1 having an inclined angle not more than 15 degrees preferably The corrugated rails 1*a*, 1*b* can also be formed as symmetrical when projectively viewed from their transverse direction, in which the base 1 is formed as a symmetrically corrugated base and seat 2 is formed with at least a pair of rollers thereunder having an annular groove 211 movably engaged with the symmetrically corrugated base 1 as shown in FIG. 7. In this modification, the seat 2 is less interesting to simulate the waving rowing than that as aforementioned.

Figure 4:
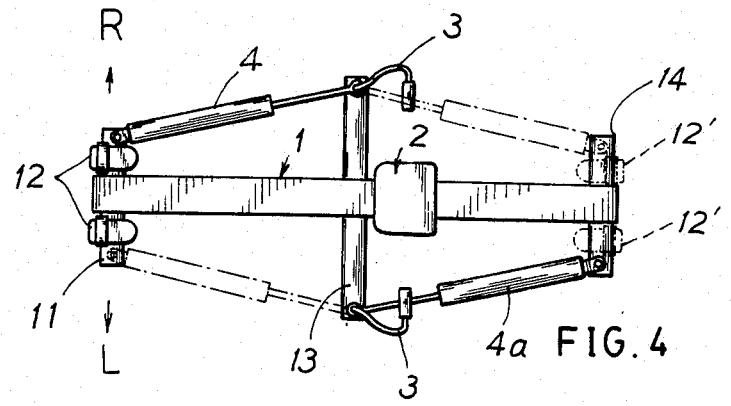
FIG. 4 is a top illustration of another preferred embodiment of the present invention.

As shown in FIG. 4, the first cylinder 4 is secured between the right-side handle 3 and the right-end of front bar 11 and the second cylinder 4*a* is secured between the left-side handle 3 and the left-end of rear bar 14 so that when pulling the right-side handle rearward by a player's right hand and pulling the left-side handle forwards by a player's left hand at the same time, a simulation of turning about a boat can be done. The cylinder 4 can be shifted to the left side and cylinder 4*a* can be shifted to right side as dotted line shown in FIG. 4. The rowing operator may also turn his sitting pose to face rearwards to tread the rear pedals 12'.

Figure 5:
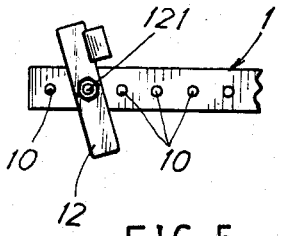
FIG. 5 shows a pedal adjustably mounted on the seat base in accordance with the present invention.
Figure 6:
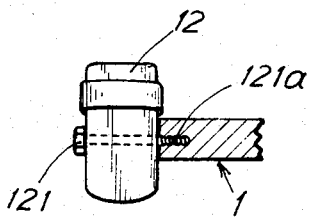
FIG. 6 is a side-view illustration as viewed from FIG. 5.

As shown in FIGS. 5, 6, the pedal 12 can be adjustably fixed on the base 1 by providing a plurality of female-threaded holes 10 longitudinally arranged on the front or rear portion of base 1. A bolt 121 is formed with a male-threaded portion 121*a* on the bolt end to engage with each female-threaded hole 10 for pivotedly fixing the pedal 12 on the base 1. By the way, the stroke of rowing operation can be adjusted by adjusting the fixation position of bolt 121 on the specific hole 10.

All the cushioning springs in this invention can be modified as any other cushioning device.

The present invention has the following advantages in comparison with the conventional rowing machine:

1. The corrugated rails, central fulcrum stands and cushioning springs are provided to imitate the waving rowing to enjoy the feeling like floating on a tide or water waves so as to spur the player's interest and increase the function of this invention.

2. The cylinders 4 as shown in FIG. 4 serve to simulate the turning about of a boat to further increase the vividness of the present invention.

3. The pedal can be adjustably fixed on the seat base to adjust the rowing stroke adapted for the player's leg length or for disabled leg.

The seat base 1 may also be directly pivotedly mounted on a single fulcrum stand 131 which is centrally positioned under the base 1 (not shown).

I claim:

1. A dynamic rowing machine comprising:

a seat base including a front bar transversely fixed on the front portion of said base and pivotedly fixed with a pair of pedals disposed on both opposite sides of said base, a central bar transversely fixed on the central portion of said base, and a rear bar transversely fixed on the rear portion of said base;

a seat having at least a pair of wheels formed thereunder, operatively moving on said seat base;

a pair of oar handles pivotedly fixed on the two opposite sides of said central bar; and a pair of restoring cylinders each pivotedly secured between each said oar handle and one end portion of said front bar;

the improvement which comprises:

said seat base formed with a pair of corrugated rails formed on two opposite longitudinal edges of said base, said two rails being unsymmetrical as projectively viewed from their transverse direction;

said seat formed with said pair of wheels thereunder each wheel formed with an annular arched groove along the wheel perimeter to rotatably move on each said corrugated rail which is concave downwards from it transverse sectional view to movably engage with the annular arched groove of said wheel;

both said front bar and said rear bar provided with a plurality of cushioning springs thereunder; and said central bar rotatably mounted within a pair of collars each having bearing therein and each mounted on a fulcrum stand supporting each end portion of said central bar.

2. A rowing machine according to claim 1, wherein one said corrugated rail is higher than the other corrugated rail to form a slope transversely across the width of said base having an inclined angle preferably less than fifteen degrees.

3. A rowing machine according to claim 1, wherein one of said restoring cylinders is secured between the right-side handle and the right-end of said front bar and the other restoring cylinder is secured between the left-side handle and the left-end of said rear bar whereby upon the pulling of said right-side handle rearwards and the pulling of said left-side handle forwards, a simulation of turning about a boat can be made.

4. A rowing machine according to claim 1, wherein said pedal is adjustably fixed on said base by providing a plurality of holes on said base so that a bolt can be adjustably fixed into said hole for pivotedly fixing said pedal on said base for adjusting the rowing stroke.

5. A dynamic rowing machine comprising:

a seat base including a front bar transversely fixed on the front portion of said base and pivotedly fixed with a pair of pedals disposed on both opposite sides of said base, a central bar transversely fixed on the central portion of said base, and a rear bar transversely fixed on the rear portion of said base, both said front bar and said rear bar provided with a plurality of cushioning springs thereunder, said central bar rotatably mounted within a pair of collars each mounted on a fulcrum stand;

a seat having at least a pair of rollers formed thereunder operatively moving on said seat base;

a pair of oar handles pivotedly fixed on the two opposite sides of said central bar; and a pair of restoring cylinders each pivotedly secured between each said oar handle and one end portion of said front bar;

the improvement which comprises:

said seat base formed with a pair of corrugated rails formed on two opposite longitudinal edges of said base, said two rails being symmetrical when projectively viewed from their transverse direction;

and said seat formed with said pair of rollers thereunder, each roller having an annular groove movably engaged with said symmetrically corrugated base.

* * * * *